US009459080B2

(12) United States Patent
Collins et al.

(10) Patent No.: US 9,459,080 B2
(45) Date of Patent: Oct. 4, 2016

(54) VENTING SYSTEM FOR A JET CUTTER IN THE EVENT OF DEFLAGRATION

(71) Applicant: Hunting Titan, Inc., Pampa, TX (US)

(72) Inventors: William Richard Collins, Burleson, TX (US); Ian Douglas Rudnik, Vassar, MI (US); Mark Allan Pederson, Bynum, TX (US)

(73) Assignee: Hunting Titan, Inc., Pampa, TX (US)

( * ) Notice: Subject to any disclaimer, the term of this patent is extended or adjusted under 35 U.S.C. 154(b) by 83 days.

(21) Appl. No.: 14/196,160

(22) Filed: Mar. 4, 2014

(65) Prior Publication Data

US 2015/0308795 A1 Oct. 29, 2015

Related U.S. Application Data

(60) Provisional application No. 61/794,477, filed on Mar. 15, 2013.

(51) Int. Cl.

| | |
|---|---|
| ***F42B 1/00*** | (2006.01) |
| ***F42B 1/02*** | (2006.01) |
| ***F42D 5/00*** | (2006.01) |
| ***F42D 1/00*** | (2006.01) |

(52) U.S. Cl.

CPC . *F42B 1/02* (2013.01); *F42D 1/00* (2013.01); *F42D 5/00* (2013.01)

(58) Field of Classification Search

CPC ..... E21B 43/117; E21B 43/116; F42B 3/08; F42B 1/02; F42B 12/18; F42B 1/00; F42D 1/00

USPC ..... 102/306–310

See application file for complete search history.

(56) References Cited

U.S. PATENT DOCUMENTS

| | | | |
|---|---|---|---|
| 3,327,630 | A | 6/1967 | Bell |
| 3,777,772 | A | 12/1973 | Arnold et al. |
| 3,978,795 | A | 9/1976 | Strunk et al. |
| 4,703,695 | A | 11/1987 | Langer |
| 4,881,445 | A | 11/1989 | Hayes |
| 4,951,572 | A | 8/1990 | Bocker et al. |
| 5,133,259 | A | 7/1992 | Schluckebier |
| 5,155,298 | A | 10/1992 | Koontz |
| 5,239,929 | A | 8/1993 | Nilsson et al. |
| 5,351,622 | A | 10/1994 | Ekholm |
| 5,837,925 | A | 11/1998 | Nice |
| 5,902,954 | A | 5/1999 | Hetz |
| 6,179,944 | B1 | 1/2001 | Monolo et al. |

(Continued)

OTHER PUBLICATIONS

Notification of transmittal of International Search Report and Written Opinion, PCT Application No. PCT/US2014/059003, mailed Jan. 6, 2015, 9 pages.

(Continued)

*Primary Examiner* — Samir Abdosh

(74) *Attorney, Agent, or Firm* — Jason Saunders; Arnold, Knobloch & Saunders, L.L.P.

(57) ABSTRACT

A jet cutter venting apparatus and method for venting gases generated during deflagration. The venting apparatus and method including vent grooves inside the jet cutter providing a pathway for deflagration gases to escape. The venting apparatus and method also may include using notches or holes placed inside the jet cutter to facilitate the venting of gases during deflagration. The venting of the gases during deflagration facilitates pressure relief within the jet cutter and increases safety from accidental detonation during a fire.

32 Claims, 4 Drawing Sheets

(56) References Cited

U.S. PATENT DOCUMENTS

| | | | | |
|---|---|---|---|---|
| 6,363,855 | B1 | 4/2002 | Kim et al. | |
| 6,453,817 | B1 | 9/2002 | Markel et al. | |
| 7,025,000 | B1 | 4/2006 | Wong et al. | |
| 7,150,231 | B2 | 12/2006 | Olofsson | |
| 7,174,834 | B2 | 2/2007 | Dion et al. | |
| 7,331,292 | B1 | 2/2008 | Kim et al. | |
| 7,530,314 | B2 | 5/2009 | Skinner et al. | |
| 7,819,064 | B2 | 10/2010 | Saenger et al. | |
| 8,302,534 | B2 * | 11/2012 | Yang | F42B 3/08 102/306 |
| 8,356,727 | B2 | 1/2013 | Traxler et al. | |
| 8,561,683 | B2 * | 10/2013 | Wood | E21B 29/02 166/298 |
| 2003/0111220 | A1 * | 6/2003 | Bell | E21B 29/02 166/55 |
| 2011/0232519 | A1 | 9/2011 | Sagebiel | |
| 2012/0067578 | A1 * | 3/2012 | Wood | E21B 29/02 166/299 |
| 2013/0299194 | A1 | 11/2013 | Bell et al. | |

OTHER PUBLICATIONS

Maykut et al., Reduced Temperature Sensitivity Launch Motor, United States Statutory Invention Registration No. H795, Published Jul. 3, 1990, 4 pages.

Cherry et al., Solid Propellant Rocket Motor with Fusible End Closure Holder, United States Statutory Invention Registration No. H1144, Published Mar. 2, 1993.

* cited by examiner

VENTING SYSTEM FOR A JET CUTTER IN THE EVENT OF DEFLAGRATION

FIELD

The invention generally relates to jet cutters utilizing explosive materials. More particularly, the invention relates to shaped charge explosive devices designed primarily for cutting tubulars in a well, including but not limited to casing, tubing, piping, and liners.

BACKGROUND

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

When placing any type of tubular downhole there is a risk that it can get stuck in the well. This can happen for several reasons including: the well has partially collapsed, operator error, or due to the geometry of the drilling path. Once the tubular becomes stuck, a variety of non-destructive means are available for the operator of the rig to try and free the tubular. These include rotating the tubular, jolting the tubular, or simply pulling up on the tubular until it comes free. However, if these options are unsuccessful then the operator might have to resort to using a cutting or severing tool such as a jet cutter to cut the tubular.

Tubulars may also be cut in abandonment operations. Abandonment operations are increasingly subject to regulations to provide for minimizing the long term environmental impact of abandoned wells. An operator will often times have to remove miles of tubulars while contending with cemented equipment, damage in the wellbore, or other unforeseen difficulties. The jet cutter is a critical tool that allows the operator to cut and retrieve tubulars from the well. The demand for cleaner abandoned wells, in conjunction with the growing number of idle wells in general, is a driving force in the market for jet cutters.

A jet cutter is an explosive shaped charge that has a circumferential V-type shape. The explosive is combined with a liner. The components are all contained in a housing. The jet cutter is lowered to the desired point where the separation of the tubular is desired. When the jet cutter is detonated, it will generate a jet of high energy plasma, typically in 360 degrees of direction, that will severe the tubular. Afterwards, the upper portion of the tubular is pulled out of the well. Then the operator can use a fishing tool to remove the still stuck lower portion of the tubular.

While other types of tubular cutters are available, including mechanical cutting devices and chemical cutters, the focus of this invention is on explosive shaped charge jet cutters that are widely used throughout the oil industry. Jet cutters have increased in popularity due to improvements in reliability and the increased use of horizontal wells.

A shaped charge is a term of art for a device that when detonated generates a focused explosive output. This is achieved in part by the geometry of the explosive in conjunction with a liner in the explosive material. Many materials are used for the liner, some of the more common metals include brass, copper, tungsten, and lead. When the explosive detonates the liner metal is compressed into a super heated, super pressurized jet that can penetrate metal, concrete, and rock.

Shaped charges must be transported from a manufacturing facility to the field. The high explosives must be maintained and designed such that the risk of any premature or unintended detonation is mitigated against. Shaped charges are transported by a variety of transportation methods, in all climates and temperature ranges, and may be subject to temperature variations, vibrations, mishandling, and fire. They often have to travel across multiple legal boundaries, with varying safety requirements.

One of the safety requirements is that if the shaped charge is in a fire, it will not detonate but instead will burn or deflagrate. This requires that pressure buildup within the housing is minimized while the explosive material is burning. A rapid buildup in pressure while burning could lead to detonation of the shaped charge.

A common method of retaining the explosive material inside a shaped charge is to use an adhesive to hold the explosive, liner, and housing intact. Under deflagration, this adhesive may melt and not constrain the gases building up in the housing from escaping. The problem with using an adhesive is that it must be applied during the assembly process of the shaped charge, adding extra manufacturing costs. Also, the adhesive is susceptible to shock and heat, thereby compromising the assembled shaped charge, especially during shipping and storage.

Shaped charges contain many components that must be held into place effectively. Several methods for retaining the shaped charge components will restrict the ability of the shaped charge to vent gases in the event that the shaped charge begins deflagrating due to a fire. In order to meet safety and transportation requirements, the shaped charge must be designed such that in the event the shaped charge catches fire, the gases produced from the deflagration will safely vent out of the tool without excessive pressure buildup. However, providing operators with the level of quality necessary for cutting without adversely affecting the well requires all the components to be precisely positioned within the tool.

Current methods for allowing a shaped charge to deflagrate safely during transportation include shipping the shaped charge partially disassembled. This can include shipping the shaped charge in multiple pieces or simply leaving out o-rings that seal the housing. This option is not ideal because it requires some form of post-shipping assembly to prepare the shaped charge for use. This reduces the quality control from the manufacturer's perspective because some form of assembly work is being performed outside of the manufacture's control. There is a risk that incorrect operator training, conditions at the well site, or other unforeseen difficulties will result in a faulty assembly that affects performance of the tool or even causes a premature detonation.

A manufacturer of shaped charges would prefer to have the entire assembly process, from start to finish, occur in its facilities where the proper safety protocol and manufacturing techniques are known to be used. This reduces the failures in the field and provides the customer with a finished product ready for use, with a known quality. Therefore, a need exists for new designs in shaped charges that can allow for safely shipping a fully assembled product, ready to use, that complies with various licensing requirements.

BRIEF DESCRIPTION OF THE DRAWINGS

For a thorough understating of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF THE DRAWINGS

In the following description, certain terms have been used for brevity, clarity, and examples. No unnecessary limitations are to be implied therefrom and such terms are used for descriptive purposes only and are intended to be broadly construed. The different systems and method steps described herein may be used alone or in combination with other systems and method steps. It is to be expected that various equivalents, alternatives, and modifications are possible within the scope of the appended claims.

Figure 1:
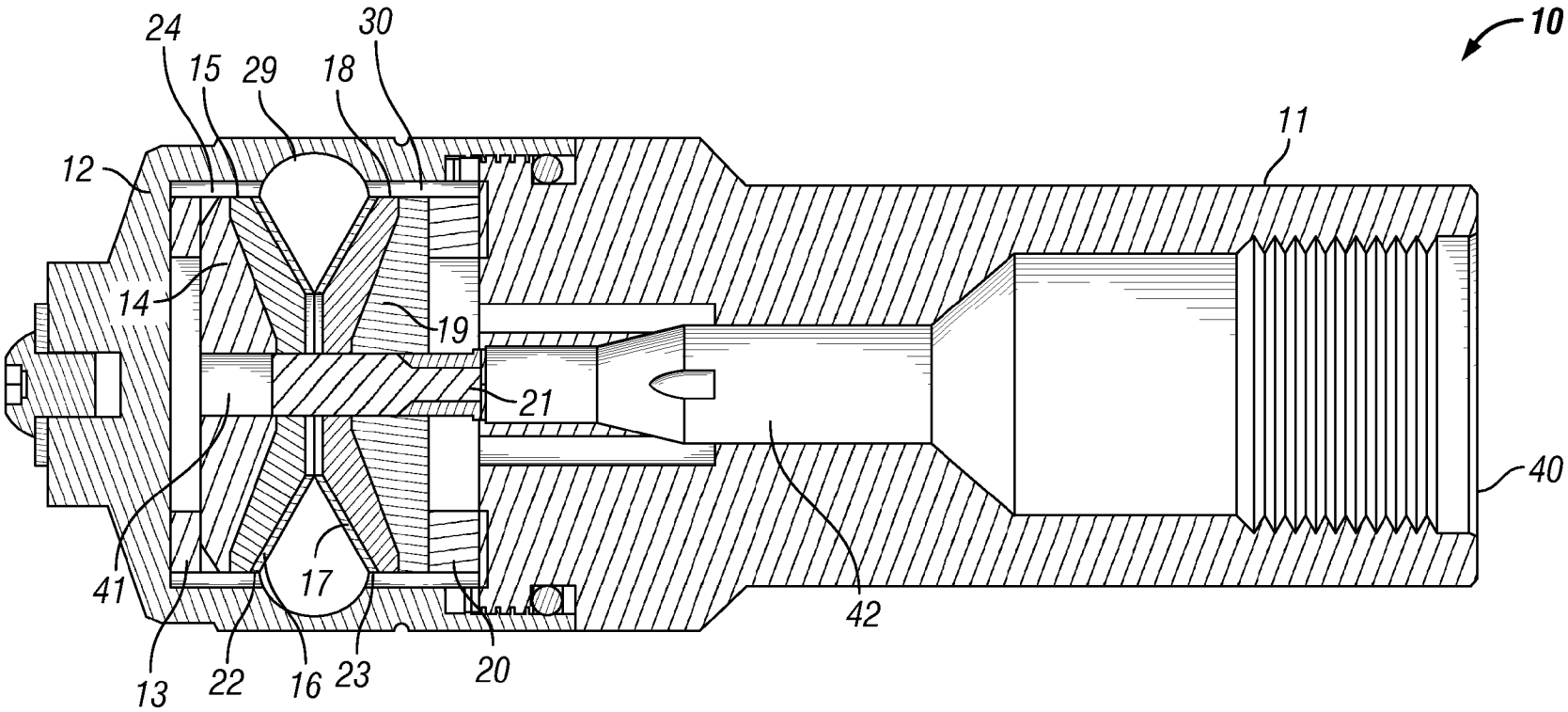
FIG. 1 is an axial cross-section of an example jet cutter.

FIG. 1 illustrates an example jet cutter 10 containing an upper housing 11 and a lower housing 12. The lower housing 12 contains a first compression device 13, a first backer plate 14, a first explosive material 15, a first liner 16, a second liner 17, a second explosive material 18, a second backer plate 19, and a second compression device 20. The lower housing 12 also contains an explosive booster 21 used to initiate the first explosive material 15 and second explosive material 18. The first liner 16 has a liner rim 22. The second liner 17 has a liner rim 23. The lower housing 12 has an inner wall 29. The inner wall 29 has a first set of vent grooves 24 located adjacent to the first liner 16 and the first explosive material 18. The inner wall 29 has a second set of vent grooves 30 located adjacent to the second liner 17 and the second explosive material 18. The first set of vent grooves 24 and the second set of vent grooves 30 may each include one or more vent grooves that are located within the inner wall 29 by means of standard manufacturing processes, including but not limited to machining, stamping, or forging.

The embodiment of FIG. 1 operates by venting pressure out of the lower housing 12 during the deflagration of the explosive material 15 and/or 18. The first compression device 13, first backer plate 14, first explosive material 15, first liner 16, second liner 17, second explosive material 18, second backer plate 19 and second compression device 20 all have openings in the center. The openings are lined up such that there is an open space 41 through most of the length of lower housing 12. A booster 21 or other equivalent explosive device is placed in the open space 41. The open space 41 is adjacent to an open space 42 in the upper housing 11. The open space 42 is the length of the upper housing 11, which has an opening 40. When the explosive materials 15 and/or 18 deflagrate they produce combustion products including high pressure, high temperature gases. In this embodiment illustrated in FIG. 1, those gases generated by deflagration will not be trapped in the lower housing 12 and can travel through the lower housing 12 by means of the vent grooves 24 and 30. The gases are put into communication with the ambient pressure located at the opening 40 by way of the open spaces 41 and 42 and the vent grooves 24 and 30. The pressurized gases, having a path of least resistance out of the lower housing 12, will vent out of the lower housing and therefore reduce any pressure buildup in the lower housing 12 and eventually equalize the pressure in the lower housing 12 and the upper housing 11. This gas venting will reduce the likelihood of a detonation of the explosive materials 15 and/or 18.

Figure 2:
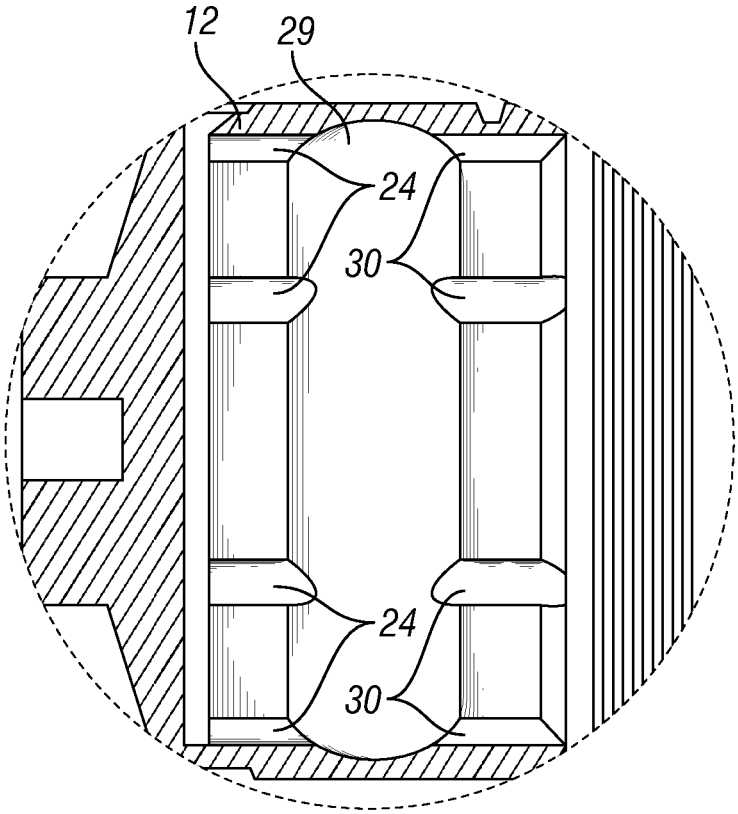
FIG. 2 is an axial cross-section of an example jet cutter housing.

FIG. 2 illustrates an example lower housing 12. The lower housing 12 in this example has a first set of vent grooves 24 and a second set of vent grooves 30 located axially about the center of the lower housing 12. These vent grooves 24 and 30 are adapted to aid in venting away pressure that may build up in the lower housing 12. Possible reasons for pressure building up in the lower housing 12 includes, but is not limited to, exposure of the lower housing 12 to fire, heat, or high energy release. The vent grooves 24 and 30 provide pathways for pressurized gases to move through the lower housing 12.

Figure 3:
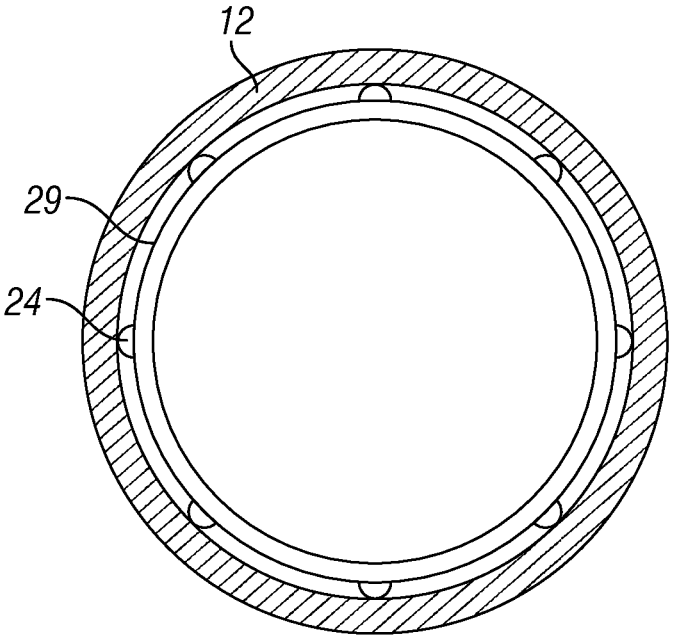
FIG. 3 is a planar cross-section of an example jet cutter housing.

FIG. 3 illustrates an example lower housing 12 with a plurality of vent grooves 24. In this example, there are six vent grooves 24 that are cut into the inner wall 29 of the lower housing 12.

Figure 4:
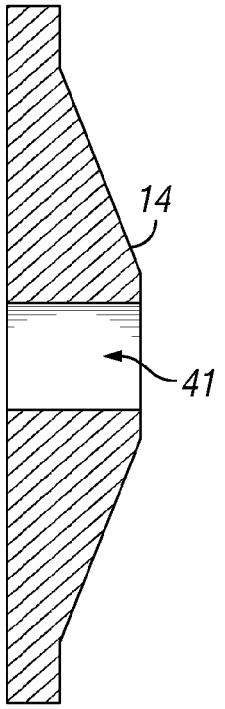
FIG. 4 is an axial cross-section of an example backer plate.

FIG. 4 illustrates a backer plate 14. The backer plate 14 is placed inside the lower housing 12 in between the compression device 13, which by way of example could be a wave spring, and the first explosive material 16.

Figure 5:
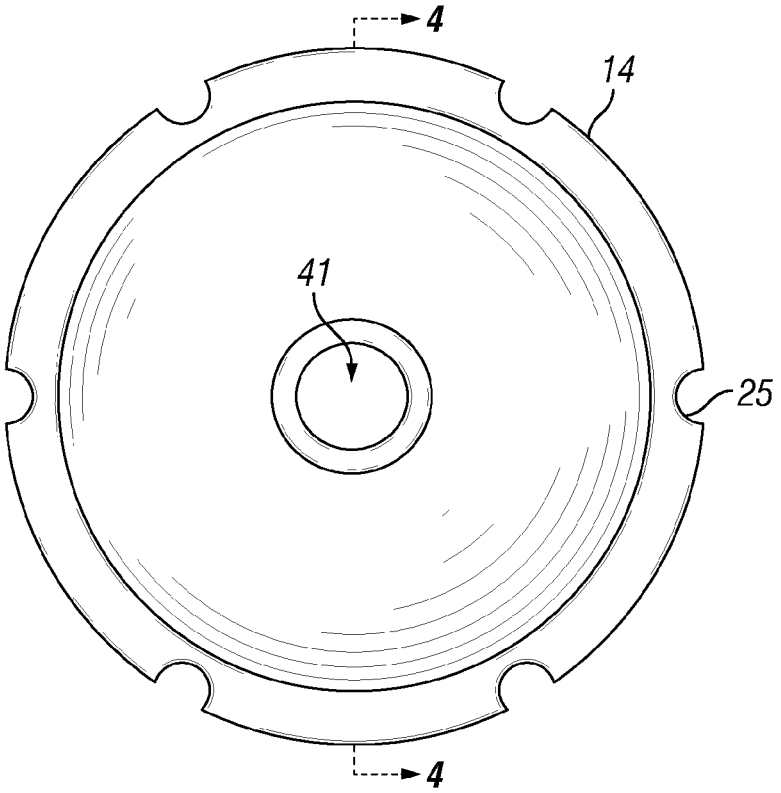
FIG. 5 is a planar cross-section of an example backer plate.

FIG. 5 illustrates a backer plate 14 with notches 25 located about the center axis. The notches 25 are adapted to allow pressurized gases to pass around the backer plate 14. This allows pressurized gases that may build up in the lower housing 12 to move through the lower housing 12 in order to be vented out of the lower housing 12.

Figure 6:
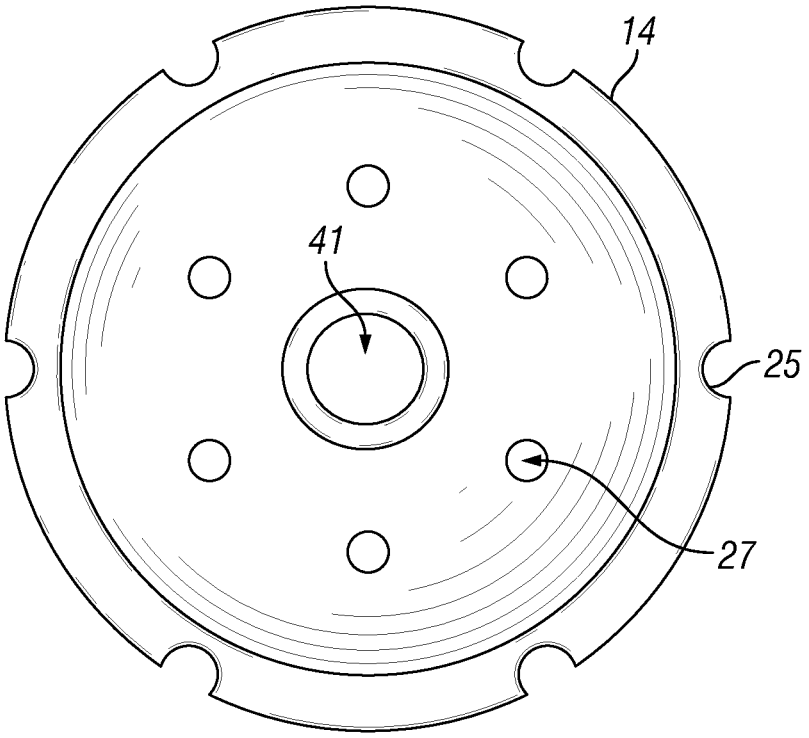
FIG. 6 is a planar cross-section of an example backer plate.

FIG. 6 illustrates a backer plate 14 with holes 27 and notches 25 placed about the center axis. The holes 27 are thru holes and allow gases to move through the backer plate. The holes 27 in conjunction with the notches 25 helps move pressurized gases through the lower housing 12.

In at least one embodiment, the first backer plate 14 has one or more notches 25. The second backer plate 19 has one or more notches 26. The notches 25 and 26 facilitate the gas venting needed to prevent the detonation of the explosive materials 15 and/or 18 if they are exposed to heat and/or deflagration.

In another embodiment, the lower housing 12 has a first set of grooves 24 and a second set of vent grooves 30. The vent grooves 24 and/or 30 facilitate the gas venting needed to prevent a detonation of the explosive material 15 and/or 18 during deflagration.

In another embodiment, the lower housing 12 has a first set of vent grooves 24 and a second set of vent grooves 30. The backer plate 14 has notches 25 and the backer plate 19 has notches 26. In various examples, the notches and grooves may or may not line up. There may be a comparative number of notches 25 and 26 to the number of vent grooves 24 and 30. The notches 25 and 26 in conjunction with the vent grooves 24 and 30 facilitate the gas venting needed to prevent a detonation of the explosive material 15 and/or 18 during deflagration.

In another embodiment, the backer plate 19 has vent holes 27 that facilitate the gas venting needed to prevent a detonation of the explosive material 15 and/or 18 during deflagration.

In another embodiment, the lower housing 12 has one or more vent grooves 24 and 30. The backer plate 14 has notches 25 and the backer plate 19 has notches 26. The backer plate 14 has one or more vent holes 28 and the backer plate 19 has one or more vent holes 27. The notches 25 and 26 in conjunction with the vent grooves 24 and 30 and the vent holes 27 and 28 facilitate the gas venting needed to prevent a detonation of the explosive material 15 and/or 18 during deflagration.

In another embodiment, the lower housing 12 has one or more vent grooves 30. The backer plate 19 has notches 26. The notches 26 and the vent grooves 30 together assist in providing a pathway for excess pressure to exit the lower housing 12. In this embodiment only one set of vent grooves 30 and only one set of notches 26 are required to facilitate pressure venting during the deflagration of explosive material 15 and/or 18.

In another embodiment, the lower housing 12 has one or more vent grooves 24. The backer plate 14 has notches 25. The notches 25 and the vent grooves 24 together assist in providing a pathway for excess pressure to exit the lower housing 12. In this embodiment only one set of vent grooves 24 and only one set of notches 25 are required to facilitate pressure venting during the deflagration of explosive material 15 and/or 18.

Although the invention has been described in terms of particular embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention. In particular, use of the terms "groove", "ring", and "vent" herein and within the claims to follow are defined expansively to encompass equivalent terms that are well known in the art.

The invention claimed is:

1. A jet cutter assembly comprising:

a housing having a substantially cylindrical wall with an inner surface and an outer surface and at least one vent groove extending into the inner surface of the wall;

an explosive material having at least a first explosive surface and a second explosive surface; and a liner having at least a first liner surface and a first liner rim;

at least one backer plate with an at least one backer plate rim;

wherein the first liner surface is adjacent to the first explosive surface, the second explosive surface is adjacent to the at least one backer plate, and the liner rim is adjacent to the wall.

2. The assembly according to claim 1, wherein a plurality of vent grooves are located extending into the inner surface of the wall.

3. The assembly according to claim 1, wherein the at least one vent groove has an upper portion above the liner rim and a lower portion below the liner rim.

4. The assembly according to claim 3, wherein the at least one vent groove is adapted to allow venting of gases around the liner.

5. The assembly according to claim 4, wherein the at least one vent groove is a plurality of grooves spaced substantially equally apart on the inner surface of the wall.

6. The assembly according to claim 3, wherein the at least one vent groove is adapted to allow venting of gases around the at least one backer plate.

7. The assembly according to claim 3, wherein the at least one vent groove is adapted to allow venting of gases around the at least one backer plate and the at least one liner.

8. The assembly according to claim 1, wherein the at least one vent groove is positioned and arranged to provide venting of gases around the liner.

9. The assembly according to claim 1, wherein the at least one vent groove is adapted to substantially equalize pressure across the inner surface of the wall.

10. The assembly according to claim 9, wherein the at least one vent groove is a longitudinal trench along the length of the inner surface of the wall adjacent to the liner rim.

11. The assembly according to claim 1, wherein the backer plate has at least one vent.

12. The assembly according to claim 11, wherein the at least one vent is at least one hole.

13. The assembly according to claim 11, wherein the at least one vent is at least one notch.

14. A jet cutter housing adapted to contain explosive material and a liner comprising:

a closed rigid cross section revolved around a center axis with an inner surface parallel to the center axis;

at least one backer plate with an at least one backer plate rim;

the liner having a liner rim; and at least one vent groove extending into the inner surface parallel to the center axis;

wherein the at least one vent groove is adapted to vent gases from deflagration of the explosive material.

15. The apparatus according to claim 14, wherein the at least one vent groove is positioned and arranged to provide venting of gases around the liner.

16. The assembly according to claim 14, wherein the at least one vent groove is adapted to allow venting of gases around the at least one backer plate.

17. The assembly according to claim 14, wherein the at least one vent groove is adapted to allow venting of gases around at least one backer plate and the at least one liner.

18. The apparatus according to claim 15, wherein the at least one vent groove is a plurality of vent grooves positioned and arranged about the center axis.

19. The assembly according to claim 14, wherein the at least one vent groove is adapted to substantially equalize pressure across the inner surface.

20. The assembly according to claim 19, wherein the at least one vent groove is a longitudinal trench along the length of the inner surface adjacent to the liner rim.

21. A jet cutter housing adapted to contain an explosive material and a liner comprising:

a substantially cylindrical portion with an inner wall; and at least one vent groove extending into the inner wall of the cylindrical portion.

22. The apparatus according to claim 21, wherein the at least one vent groove is positioned and arranged to provide a path for gases to vent around the liner.

23. The apparatus according to claim 22, wherein the at least one vent groove is a plurality of vent grooves positioned and arranged about the center axis.

24. The apparatus according to claim 21, wherein the at least one vent groove is adapted to substantially equalize pressure across the inner wall.

25. A jet cutter assembly comprising;

a first liner having a first liner rim;

a second liner having a second liner rim;

a first backer plate having a first backer plate rim;

a second backer plate having a second backer plate rim;

a first explosive element retained between the first liner and the first backer plate;

a second explosive element retained between the second liner and the second backer plate;

a substantially cylindrical housing having a first inner surface and a second inner surface offset axially, wherein the housing is adapted to contain the first liner, the second liner, the first explosive element, the second explosive element, the first backer plate, and the second backer plate;

a plurality of first longitudinal vent grooves extending into the first inner surface adapted to provide pressure venting around the first liner and first backer plate; and a plurality of second longitudinal vent grooves extending into the second inner surface adapted to provide pressure venting around the second liner and second backer plate.

26. The assembly according to claim 25, wherein the first backer plate is adapted for venting.

27. The assembly according to claim 25, wherein the second backer plate is adapted for venting.

28. The assembly according to claim 26, wherein the first backer plate has at least one notch in the first backer plate rim.

29. The assembly according to claim 27, wherein the second backer plate has at least one notch in the second backer plate rim.

30. The assembly according to claim 25, wherein the first backer plate has a plurality of notches in the first backer plate rim adapted for venting and the second backer plate has a plurality of notches in the second backer plate rim adapted for venting.

31. The assembly according to claim 25, wherein the first backer plate has a plurality of holes adapted for venting and the second backer plate has a plurality of holes adapted for venting.

32. The assembly according to claim 25, wherein the first backer plate has at least one hole and at least one notch adapted for venting and the second backer plate has at least one hole and at least one notch adapted for venting.

* * * * *